United States Patent [19]

Just

[11] 4,246,841

[45] Jan. 27, 1981

[54] BAND STAMP

[76] Inventor: Walter Just, P.O.B. 186, A - 4600 Wels, Austria

[21] Appl. No.: 5,337

[22] Filed: Jan. 22, 1979

[30] Foreign Application Priority Data

Feb. 27, 1978 [AT] Austria ..... 1380/78

[51] Int. Cl.[3] ..... B41J 1/60

[52] U.S. Cl. ..... 101/111

[58] Field of Search ..... 101/105, 111, 405

[56] References Cited

U.S. PATENT DOCUMENTS

| | | | |
|---|---|---|---|
| 1,301,926 | 4/1919 | Folger et al. | 101/111 |
| 2,029,128 | 1/1936 | Schonfelder | 101/111 |
| 2,853,002 | 9/1958 | Robinson | 101/111 |
| 3,796,152 | 3/1974 | Finke | 101/111 |

FOREIGN PATENT DOCUMENTS

| | | | |
|---|---|---|---|
| 1241993 | 8/1971 | United Kingdom | 101/111 |

*Primary Examiner*—Edward M. Coven
*Attorney, Agent, or Firm*—Kurt Kelman

[57] ABSTRACT

An integral plastic housing has front and rear walls, which terminate in downwardly extending tongues which define slots open at their lower ends, and two opposite side walls adapted to be resiliently spread apart and formed with axially aligned apertures. An axle is snap-fitted in the apertures. A cross-piece is fitted on the side walls at the lower end of the housing. At least one drum is mounted on the axle and rotatable about the axis thereof and integrally formed with a setting wheels which protrudes through the slots. At least one stamp band is trained around the drum and the cross-piece and adapted to be engaged with the underside of the cross-piece and to be forced by the latter against a surface to be stamped. The side walls are adapted to be sufficiently spread apart to permit the axle to be inserted into the housing from below and to be snap-fitted into said apertures.

2 Claims, 4 Drawing Figures

BAND STAMP

Figure 1:
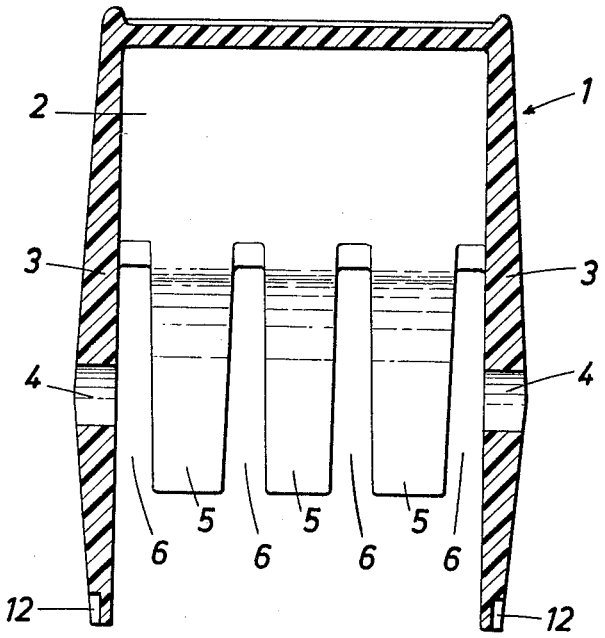

This invention relates to a band stamp comprising a plastic housing, an axle which extends from one side wall of the housing to the other and is held in apertures in the side walls, a plurality of drums, which are mounted on the axle and are rotatable thereon independently of each other and provided with respective setting wheels which protrude through slots in the front and rear walls of the housing and a plurality of stamp bands trained around respective ones of the drums and around a cross-piece, which is fitted on the two side walls of the housing and serves as a backing for the bands during the stamping operation.

Such band stamps are often used, e.g., as date stamps, in which one stamp belt carries the type characters for the year, the next stamp band carries the type characters for the names of the months, and two additional stamp bands carry the type characters for the digits required for an indication of the days of a month. Because the drums around which the stamp bands are trained can be rotated independently of each other by means of their setting wheels and a rotation of a drum will move the associated stamp band in its longitudinal direction, the stamp can be set to any desired date by moving the stamp bands to such positions that the type characters for indicating the desired date are backed by the cross-piece.

The plastic housing has previously been made of two parts so that the axle which carries the drums provided with the setting wheels and the stamp bands trained around the drums can be mounted in the housing. The parting line of the housing extended through the axle and normal to the surface to be stamped and to the backing surface of the cross-piece. The housing was substantially closed, except for narrow slots which are formed in the front and rear walls and closed at both ends and through which the setting wheels protrude, and for a window providing a passage for the stamp bands adjacent to the cross-piece. Whereas the two housing parts can be held together at their lower end by the cross-piece, they must be connected by additional means at a substantial distance therefrom. Such additional connecting means may consist of a pin which protrudes inwardly from one housing part, and a sleeve, which is carried by the other housing part and receives the pin as a snap fit so that, when the unit consisting of the axle, the drums, the stamp bands trained around the drums and the cross-piece has been inserted into the housing parts, the latter can be joined as by a snap fastener. In such stamps the two housing parts are rather intricately shaped and have the further disadvantage that they cannot be entirely identical because the additional connecting means are different and the parting line must be covered. For this reason, two different molds are required for the manufacture of the two housing parts so that the costs of manufacturing the same are relatively high.

It is an object of the invention to eliminate this disadvantage and to provide a band stamp which is of the kind described first hereinbefore and can be manufactured at lower costs than the previously known stamps of that kind.

This object is accomplished according to the invention in that the plastic housing consists of a single piece and the front and rear walls of the housing terminate adjacent to the drums in tongues which between them define slots open at one end and through which the setting wheels protrude, and the axle is adapted to be snap-fitted into the apertures of the side walls of the housing when the side walls have been resiliently spread apart before the cross-piece has been fitted on the housing.

Because the axle which carries the drums with setting wheels and the stamp bands trained around the drums, can be snap-fitted into the apertures of the side walls from the lower end of the housing when the side walls of the housing have been resiliently spread apart, the housing need no longer consist of two parts so that a rather expensive, complicated mold is saved. As the front and rear walls of the housing terminate in tongues which between them define suitable slots, the assembly consisting of the axle which carries the drums and the band stamps trained around the drums can be inserted into the housing because the side walls of the housing are sufficiently unrestrained so that they can be resiliently spread apart. When the cross-piece has been fitted on the housing, the cross-piece holds the two side walls of the housing at the required distance from each other and prevents an undesired spreading apart of such side walls so that there is no risk of an unintended separation of parts of the stamp.

In order to prevent an undesired longitudinal displacement of the axle which has been mounted in the housing, the apertures in the side walls of the housing may consist of blind holes which are open only at their inner end. On the other hand, the manufacture will be simplified if the apertures in the side walls of the housing consist in known manner of circular through holes and the axle is provided near its ends with radially outwardly extending shoulders which engage the inside surfaces of the side walls of the housing. Because the tensioned stamp bands cause the ends of the axle to be eccentrically disposed in the circular holes, the shoulders will be effective to prevent a longitudinal displacement of the axle even if the circular holes have an inside diameter which exceeds the outside diameter of the shoulders.

Figure 2:
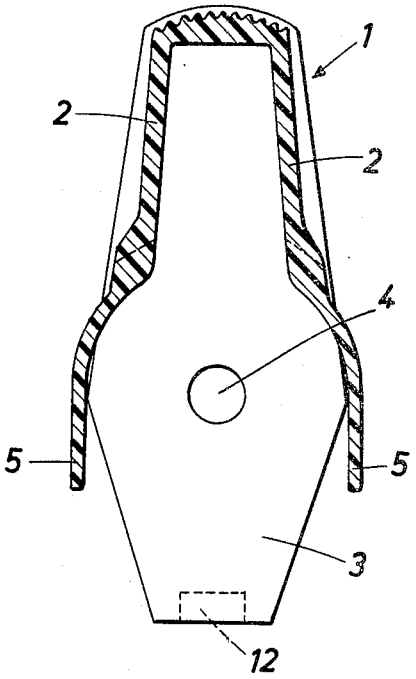
Figure 3:
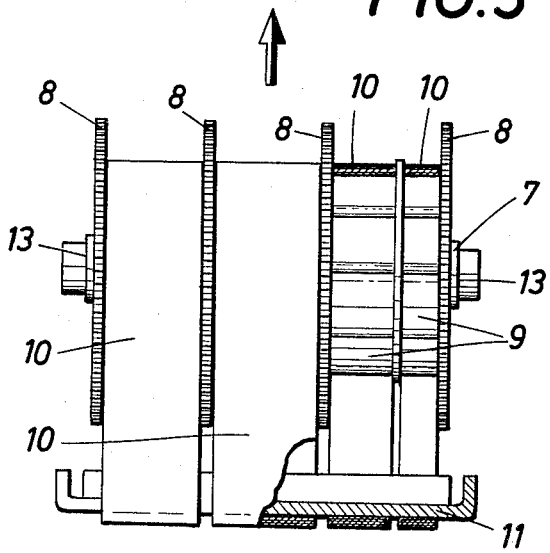
Figure 4:
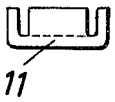

An embodiment of the invention is shown by way of example on the accompanying drawing, in which FIG. 1 is a longitudinal sectional view showing only the housing of a band stamp, FIG. 2 is a transverse sectional view showing the housing of FIG. 1, FIG. 3 is a partly sectional view showing the working assembly of the stamp and FIG. 4 is a side elevation showing the cross-piece.

The band stamp according to the invention comprises a plastic housing 1 which consists of a single part and has front and rear walls 2 and two side walls 3. The side walls 3 of the housing are formed with circular through holes 4. The front and rear walls 2 of the housing terminate in three tongues 5 which between them define slots 6, which are open at one end.

The circular holes 4 serve to receive respective ends of an axle 7 which carries four drums 9, each of which is integrally formed with a setting wheel 8 and which are mounted on the axle 7 to be rotatable independently of each other. A plurality of stamp bands 10 which carry type characters, not shown, are trained around respective ones of the drums and around a cross-piece 11 which is adapted to be fitted from below in suitable recesses 12 of side walls 3 of the housing. The cross-piece 11 serves as a backing for the stamp bands 10 during the stamping operation.

To assemble the stamp, the entire working assembly shown in FIG. 3 is inserted in the direction of the arrow in FIG. 3 into the housing 1 while the side walls 3 of the latter are resiliently spread apart, for instance, by means of a suitable tool. When the ends of the axle 7 have snapped into the circular holes 4 so that radially outwardly extending shoulders 13 provided on the axle 7 near its ends have engaged the inside surfaces of the side walls 3 of the housing, the cross-piece can be fitted onto the side walls 3.

The parting line of the mold used to manufacture the housing 1 extends suitably through the axis of the circular holes 4 and normal to the plane of the drawing. The invention is not restricted to stamps having drums and bands in the number which has been shown. A stamp may be provided with only one drum and only one stamp band, provided that the side walls 3 of the housing are separated from the front and rear walls 2 of the housing in the region below the drums so that the side walls 3 of the housing can be spread apart.

What is claimed is:

1. In a band stamp comprising a stamping assembly which includes an axle having two ends, at least one drum mounted on the axle and rotatable about the axis thereof, a setting wheel integral with each of the drums, a cross-piece parallel to, and spaced from, the axle and a stamp band trained around each one of the drums and the cross-piece, each stamp band engaging an underside of the cross-piece and being forced thereby against a surface to be stamped; and a housing having two opposite side walls defining axially aligned apertures and front and rear walls interconnecting the side walls, the housing walls substantially enclosing the stamping assembly and the side walls engaging the cross-piece and serving as the sole means for retaining the cross-piece spaced from the axle for tensioning the stamp band about the axle and the cross-piece, the improvement of the housing walls forming a one-piece plastic unit and the enclosing housing walls of the plastic unit constituting a handle for the band stamp, the front and rear walls terminating in a tongue extending over each one of the drums from above to below the axle, adjacent ones of the tongues defining slots therebetween and each one of the tongues adjacent a respective one of the side walls defining a slot with the adjacent side wall, the slots being open at their lower ends and each setting wheel registering with a respective one of the slots and protruding radially therethrough, and the slotted interconnecting rear and front walls of the housing enabling the opposite side walls to be resiliently spread apart for insertion of the stamping assembly into the housing from below and for snap-fitting the ends of the axle in the apertures of the side walls of the housing.

2. In the band stamp of claim 1, the apertures in the side walls of the housing consisting of circular through holes adapted to receive the axle ends and further comprising shoulders on the axle adjacent the ends and engaging the side walls when the axle ends are snap-fitted into the circular through holes.

* * * * *